US006222432B1

(12) United States Patent
Wegdal

(10) Patent No.: US 6,222,432 B1
(45) Date of Patent: Apr. 24, 2001

(54) QUARTER-WAVE COAXIAL CAVITY RESONATOR

(75) Inventor: Carl Göran Wegdal, Skärholmen (SE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 0 days.

(21) Appl. No.: 09/339,102

(22) Filed: Jun. 24, 1999

(30) Foreign Application Priority Data

Jul. 1, 1998 (SE) ..... 9802354

(51) Int. Cl.[7] ..... H01P 7/04; H01P 1/202; H01P 7/06

(52) U.S. Cl. ..... 333/222; 333/206; 333/227; 333/203; 333/230

(58) Field of Search ..... 333/222, 206, 333/227, 203, 204, 202, 230

(56) References Cited

U.S. PATENT DOCUMENTS 5,262,742 * 11/1993 Bentivenga ..... 333/203
5,285,178 2/1994 Ahlberg ..... 333/224
5,389,903 * 2/1995 Piirainen ..... 333/203

FOREIGN PATENT DOCUMENTS 0 788 184 8/1997 (EP) .
WO 97/25753 7/1997 (WO) .

* cited by examiner

*Primary Examiner*—Benny Lee
*Assistant Examiner*—Stephen E. Jones
(74) *Attorney, Agent, or Firm*—Young & Thompson

(57) ABSTRACT

In a quarter-wave coaxial cavity resonator, having a cavity with a cylinder inner wall (1), and bottom (3) and top (4) walls and a symmetry axis (2) with a resonator bar (5), a high coupling degree to a feed line (12) is obtained by a T-formed antenna with two equally long arms forming the antenna proper and the stem (9) forming the lead to the feed line. The antenna proper has one end (10) electrically and mechanically connected to the bottom end (6) of the resonator rod, whereas the opposite end (11) is free, and the antenna is parallel to the resonator rod and at a small distance therefrom.

6 Claims, 1 Drawing Sheet

QUARTER-WAVE COAXIAL CAVITY RESONATOR

TECHNICAL FIELD OF THE INVENTION

The invention regards a quarter-wave coaxial cavity resonator for use in wide-band filters or combiners.

DESCRIPTION OF RELATED ART

A quarter-wave coaxial cavity resonator having a cavity comprising a cylindrical wall portion having a central symmetry axis, a bottom wall and a top wall joining the cylindrical wall at right angles, a right cylindrical resonator rod arranged coaxially along the axis and having a first end fixed from the bottom wall and a second end at a distance from the top wall, and means for feeding microwave energy to the resonator is well-known. Such resonators have been in practical use for at least some 20 years. They may have a theoretical unloaded Q value as high as 7000 and habitually reach 4000 to 6000 in manufactures for the frequency of 1.8 GHz, which is a common frequency band for telecommunication use. As the name of the device indicates, the length of the resonator rod corresponds to a quarter of the wavelength for the resonant frequency.

SUMMARY OF THE INVENTION

It is a particular object of the present invention to obtain a resonator of this type having a suitable coupling for broad-band use. Particularly in the telecommunications field, much information is sent and receive din broad microwave bands, and there exist particular problems in obtaining components which are as linear as possible in order to reduce all kinds of intermodulation.

The general tendency at present is to work with frequency bands which are as broad as possible. For example, and for the frequency band around 1.8–1.9 GHz, it is now often desired to obtain useful bandwidths of 40 MHz and even up to 80 MHz. However, already 40 MHz is a difficult limit to reach for resonators at a realistic level of signal load, since a broad bandwidth requires a high degree of coupling, and an increased coupling at a given level will lead to increased losses. Some sacrifice of Q value is therefore unavoidable in order to increase the bandwidth. It is thus an object of the invention to improve the general conditions for this balance of factors.

This object and other objects and advantages are obtained, according to the present invention, by a particular type of field coupling in a quarter-wave coaxial cavity resonator of the kind recited. Thus, an antenna having a T form is arranged within the resonator cavity in the way specified in the claims.

Although the cylindrical wall is normally a right cylindrical wall, it should be understood that in the present disclosure, the concept of cylindrical comprises not only the right cylinder having a circle as a generating curve, but comprises any form of generating curve, e.g., quadratic, or even have any regular form like a regular polygon. The same is true for the cylindrical resonator rod. For practical reasons of manufacture, however, this outer wall of the coaxial system is often made with a circular section.

With this geometry for the antenna, which is substantially a quarter-wave long, the fixed first end of the arm portion, joined with low reactance with the bottom of the resonator and with the bottom end of the resonator rod, will have maximum current and the free end thereof is at a current mode.

BRIEF DESCRIPTION OF THE DRAWINGS

The invention shall now be described by means of an exemplary embodiment and with reference to the figures.

In the respective figures, there have been used identical reference figures for similar features.

DETAILED DESCRIPTION OF THE PREFERRED EMBODIMENTS

Figure 1:
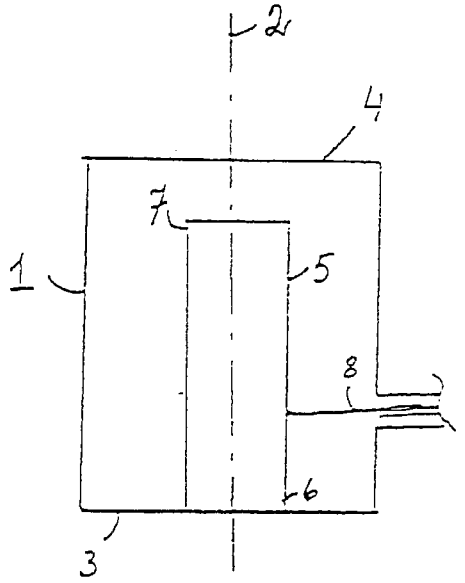
PRIOR ART Fig. 1
FIG. 1 shows a cross-section of a prior-art quarter-wave coaxial cavity resonator.

The prior art resonator shown schematically in FIG. 1 is formed by an outer cavity and an inner resonator rod. Thus, the cavity comprises a cylindrical wall portion 1 having a symmetry axis 2, a bottom wall 3 and a top wall 4. Inside the cavity is the concentric rod 5, having a first end 6 fixed to the bottom wall and a second end at a distance from the top wall. A feeder 8 may comprise, e.g., a waveguide or coaxial line connected at the cylinder wall 1 at some distance form the bottom, and a coupling lead to the resonator rod. The rod 5 has the form of a right cylinder, i.e., the section is circular. The cylindrical wall may also have a circular section, but may have other forms, like a square or other regular polygon, although the circular section may be preferred for practical reasons of manufacture.

The cavity may be cut in aluminum and the rod 5 made of brass, both having surfaces covered with silver. The actual size in FIG. 1 is approximately that of a resonator devised for the 1.8 GHz band.

Figure 2:
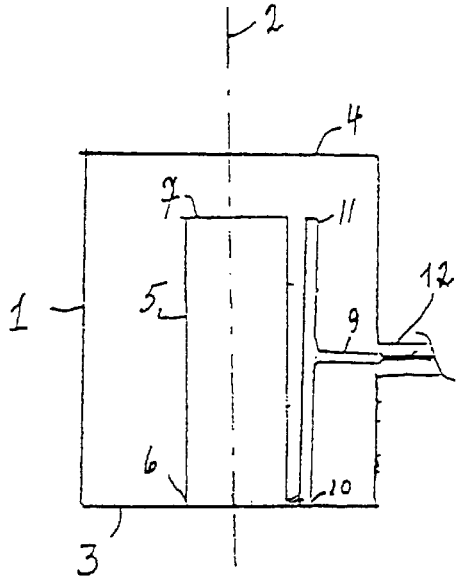
FIG. 2 shows a cross-section of an embodiment of an inventive resonator.

An inventive field coupling in a coaxial cavity is shown in FIG. 2. The cavity formed by walls 1, 3, 4 is similar to that of FIG. 1. However, the coupling device 8 in FIG. 1 has been exchanged for a field coupling, which comprises a T with a stem portion 9 and two arms forming an arm portion with ends 10 and 11. In the middle between those ends 10 and 11 is fixed one end of the stem portion 9, and the opposite end of the stem is connected to a feeder such as a waveguide or coaxial line 12 at an opening in the cylinder wall 1, which is entered at about half the height of the resonator rod 5. The arm portion has its first end joined at the bottom end of the resonator rod, either directly to the rod itself or to the bottom 3, and the rest of the arm is stretched along the resonator rod at a slight distance therefrom, of the order of a millimeter therefrom in the present example, where the figure is drawn in approximately 1:1 scale for a resonator for the 1.8 GHz band.

Thus, the antenna uses mid-feeding. The coupling coefficient is set by setting the distance between the antenna element/arm portion and the resonator rod and by slight adjustment of the length of the antenna element comprising the free end 11 thereof.

For a resonator constructed for the 1.8 GHz band, a resonator may have the following dimensions:

Cylinder wall with circular section, diameter 42 mm, Resonator rod 42 mm long, diameter 14 mm, and Cavity height about 50 mm.

The standing wave resonant oscillation in the device will be mimicking that of the antenna, as to the position of the oscillation nodes for the electrical and magnetic fields respectively, with correct mutual phase angles and with currents and voltages in phase. The hard but low-loss field coupling will give a broadband response ensuring high unloaded Q value at a high degree of coupling. The field configuration is dominated by the resonator rod and is little disturbed by the antenna, in spite of the high coupling degree, which is a major source of the low losses at unloaded Q.

Figure 3:
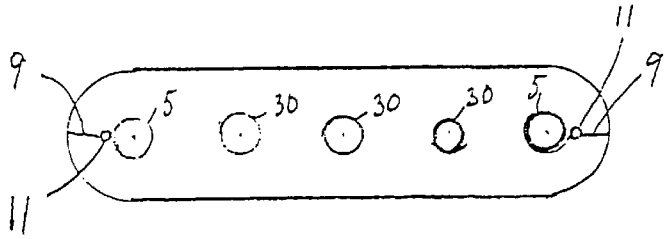
FIG. 3 shows a horizontal cross-section through a combline filter.

In FIG. 3 is shown a particular embodiment, where a plurality of resonators are mounted in a common cavity, forming a combline filter. Resonator rods 5 at the ends are provided with antennas 11, with feeders 9. In between are mounted other resonator rods 30, participating in the combline function. It is evidently possible to arrange the filter where only one resonator rod is provided with antenna and feeder.

As one of skill in the art will understand, the surfaces within the resonator will be covered at least skin-effect deep with a high-conductivity and low-oxidizing metal like silver. A particular point to be considered is the point of contact between the stem and the midpoint of the antenna, where the feeder current would be maximal. Therefore, it is preferred to make the whole T structure in one piece, e.g., of brass, or at least make the junction with special care. Depending on practical considerations, the bottom end 10 of the antenna may be soldered to the resonator rod, which is made of brass, in particular if the cavity is made of silvered aluminum and the rod fixed from underneath with a screw. In this case, and in order to obtain good electrical contact, the resonator rod at its end 6 is concave (not shown) for guaranteeing a high contact pressure around a ring.

Although the invention has been described with reference to a specific embodiment, it is clear to the man of the art that various modifications are possible, and that the scope of the invention is only to be understood from the appended claims.

What is claimed is:

1. A quarter-wave coaxial cavity resonator having a cavity comprising a cylindrical wall portion (1), a bottom wall (3) and a top wall (4) joining the cylindrical wall at right angles, a cylindrical resonator rod (5) arranged in the cavity and having a first end (6) fixed to and protruding from said bottom wall and a second end (7) at a distance from said top wall, and means (8) for feeding microwave energy to said resonator, wherein said means for feeding microwave energy comprise an antenna formed as a T having a stem portion (9) having a first end and a second end, and an arm portion, the arm portion having a first arm end (10) and a second arm end (11), the first end of the stem (9) being electrically and mechanically joined to the arm portion substantially in the middle between its first and second arm ends (10, 11), said arm portion having substantially the same length as said resonator rod (5) and being spaced a proximate distance from and substantially parallel thereto, said first arm end (10) of the arm portion being mechanically fixed and electrically connected to said bottom wall (3) in proximity to said first end (6) of the resonator rod (5), and said second arm end (11) of the arm portion being free, the second stem end being led outward to the cylindrical wall portion (1) substantially perpendicularly thereto and joined to a feeder (12).

2. A cavity resonator according to claim 1, wherein the T-formed antenna is made in one piece.

3. A cavity resonator according to claim 2, characterized in that the said first arm end (10) is bent and fixed to the bottom end (6) of the resonator rod (5).

4. A cavity resonator according to claim 1, wherein said first arm end (10) is bent and fixed to the bottom end (6) of the resonator rod (5).

5. A cavity resonator according to claim 1, further comprising a plurality of the resonator rods (5, 30) in a common cavity, one of said resonator rods (5) being provided with said antenna.

6. A cavity resonator according to claim 5, wherein two of said plurality resonator rods (5) are provided each with a separate one of said antenna.

* * * * *